US011083218B1

(12) United States Patent
Mandeville

(10) Patent No.: US 11,083,218 B1
(45) Date of Patent: Aug. 10, 2021

(54) CIGAR CUTTER

(71) Applicant: A. Mark Mandeville, Fletcher, NC (US)

(72) Inventor: A. Mark Mandeville, Fletcher, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

(21) Appl. No.: 17/188,379

(22) Filed: Mar. 1, 2021

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
See application file for complete search history.

(56) References Cited

U.S. PATENT DOCUMENTS 5,738,117 A * 4/1998 Fontaine, Jr. ..... A24F 13/26 131/249
6,164,286 A 12/2000 Schad
6,708,409 B2 3/2004 Yu
7,762,266 B2 7/2010 Strasheim
2007/0089299 A1 4/2007 Belaubre
2008/0178469 A1 7/2008 Guttman
2009/0113719 A1 5/2009 Smith
2010/0146792 A1 6/2010 Wong
2010/0257741 A1* 10/2010 Lin ..... A24F 13/26 30/112
2011/0146696 A1 6/2011 Dipple
2015/0000140 A1 1/2015 Lance et al.
2017/0020189 A1 1/2017 Fekete
2017/0231271 A1 8/2017 Almsberger et al.
2018/0303156 A1 10/2018 Miudo
2019/0380384 A1 12/2019 France
2020/0315248 A1 10/2020 Doner

* cited by examiner

*Primary Examiner* — Eric Yaary
(74) *Attorney, Agent, or Firm* — Steve LeBlanc, LLC

(57) ABSTRACT

A cigar tool includes a casing with a hole through the casing. A pair of blades is pivotally connected to the casing, and each blade has a cutting edge, a closed position detent, a cutter position detent, and a deployed position detent. A spring is operably engaged with each blade to bias the cutting edge of each blade out of the casing. An actuator extends through at least a portion of the casing and has a hold position that prevents movement of the pair of blades with respect to the casing and a release position that permits movement of the pair of blades with respect to the casing. A selector is selectively engaged with the pair of blades to allow the pair of blades to move between a closed position in which each closed position detent is engaged with the actuator, a cutter position in each cutter position detent is engaged with the selector, and a deployed position in which one deployed position detent is engaged with the actuator.

20 Claims, 14 Drawing Sheets

CIGAR CUTTER

FIELD OF THE INVENTION

The present invention generally involves a cigar tool. In particular embodiments, the cigar tool may be used as a cigar cutter, a cigar punch, or a switchblade.

BACKGROUND OF THE INVENTION

Cigars are typically made from a combination of filler tobacco, binder tobacco, and wrapper tobacco. The filler tobacco consists of smaller pieces of the most flavorful tobacco, while the binder tobacco is generally selected from larger, less flavorful tobacco leaves that can tightly contain the filler tobacco. The wrapper tobacco provides the outermost layer of the cigar and is generally selected from the most aesthetically pleasing tobacco to enhance the feel and appearance of the cigar.

The parts of a cigar are generally referred to as the head, body, and foot. The head is the end of the cigar that is placed in a user's mouth, and the foot is the end of the cigar that is lit. The wrapper tobacco is often rolled to produce a closed cap at the head of the cigar, and sometimes the foot as well, to retain freshness of the filler and binder tobacco. The user must remove a portion of the cap prior to use to create a pathway for airflow through the lit foot, through the body, and out the head.

Various methods and tools exist for removing the cap of a cigar. For example, some users prefer to simply bite off a portion of the cap. Although this method is simple and does not require a separate tool, biting off the cap typically results in an imprecise hole and a tattered cut which further degrades as the cigar is smoked, releasing bits of tobacco into the user's mouth. Other users prefer a cigar cutter to remove the cap of a cigar. Scissors-type cigar cutters use a pair of pivotally mounted sharp blades, while guillotine-type cigar cutters use a sharp blade opposed to an anvil surface or second sharp blade to slice through the cap. Scissors-type cigar cutters are easier to make and use compared to guillotine-type cigar cutters, while guillotine-type cigar cutters generally produce a cleaner cut and more uniform opening in the cap. However, thicker cigars or cigars having a blunt cap make both scissors- and guillotine-type cigar cutters difficult or impractical to use. Instead, users may prefer a cigar punch to remove the cap of thicker cigars or cigars having a blunt cap. A cigar punch generally refers to a circular sharp blade that can be pressed against the blunt cap and rotated to remove a cylindrical plug from the cap.

The preferred tool to remove the cap may thus vary according to user preference and/or the size and shape of the cigar, and multiple users with different sizes and shapes of cigars may have to share a single tool for removing the cap of a cigar. In addition, it may be desirable for the tool to include additional functionality than simply removing the cap of a cigar. Therefore, the need exists for an improved cigar tool that can provide the benefits and conveniences of a cigar cutter and a cigar punch while also having the additional functionality of a sharp blade.

BRIEF DESCRIPTION OF THE INVENTION

Aspects and advantages of the invention are set forth below in the following description, or may be obvious from the description, or may be learned through practice of the invention.

One embodiment of the present invention is a cigar tool that includes a casing with a hole through the casing that defines a perimeter. A pair of blades are pivotally connected to the casing, and each blade has a cutting edge. The pair of blades has a closed position in which the pair of blades overlap one another within the perimeter, a cutter position in which the pair of blades are separated from one another, outside the perimeter, and the cutting edges are within the casing, and a deployed position in which the cutting edge of one blade is outside the casing. A spring is operably engaged with each blade to bias the cutting edge of each blade out of the casing. An actuator extends through at least a portion of the casing and has a hold position that prevents movement of the pair of blades with respect to the casing and a release position that permits movement of the pair of blades with respect to the casing. A selector is selectively engaged with the pair of blades to allow the pair of blades to move to either the cutter position or the deployed position.

An alternate embodiment of the present invention is a cigar tool that includes a casing with a hole through the casing. A pair of blades is pivotally connected to the casing, and each blade has a cutting edge, a closed position detent, a cutter position detent, and a deployed position detent. A spring is operably engaged with each blade to bias the cutting edge of each blade out of the casing. An actuator extends through at least a portion of the casing and has a hold position that prevents movement of the pair of blades with respect to the casing and a release position that permits movement of the pair of blades with respect to the casing. A selector is selectively engaged with the pair of blades to allow the pair of blades to move between a closed position in which each closed position detent is engaged with the actuator, a cutter position in each cutter position detent is engaged with the selector, and a deployed position in which one deployed position detent is engaged with the actuator.

In yet another embodiment of the present invention, a cigar tool includes a casing and a pair of blades pivotally connected to the casing. Each blade has a cutting edge, and the pair of blades has a deployed position in which the cutting edge of one blade is outside the casing. A spring is operably engaged with each blade to bias the cutting edge of each blade out of the casing. An actuator extends through at least a portion of the casing and has a hold position that prevents movement of the pair of blades with respect to the casing and a release position that permits movement of the pair of blades with respect to the casing. A cover is slidingly engaged with the casing and has a closed position and an open position. A cigar punch is within the casing and accessible through the casing when the cover is in the open position.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
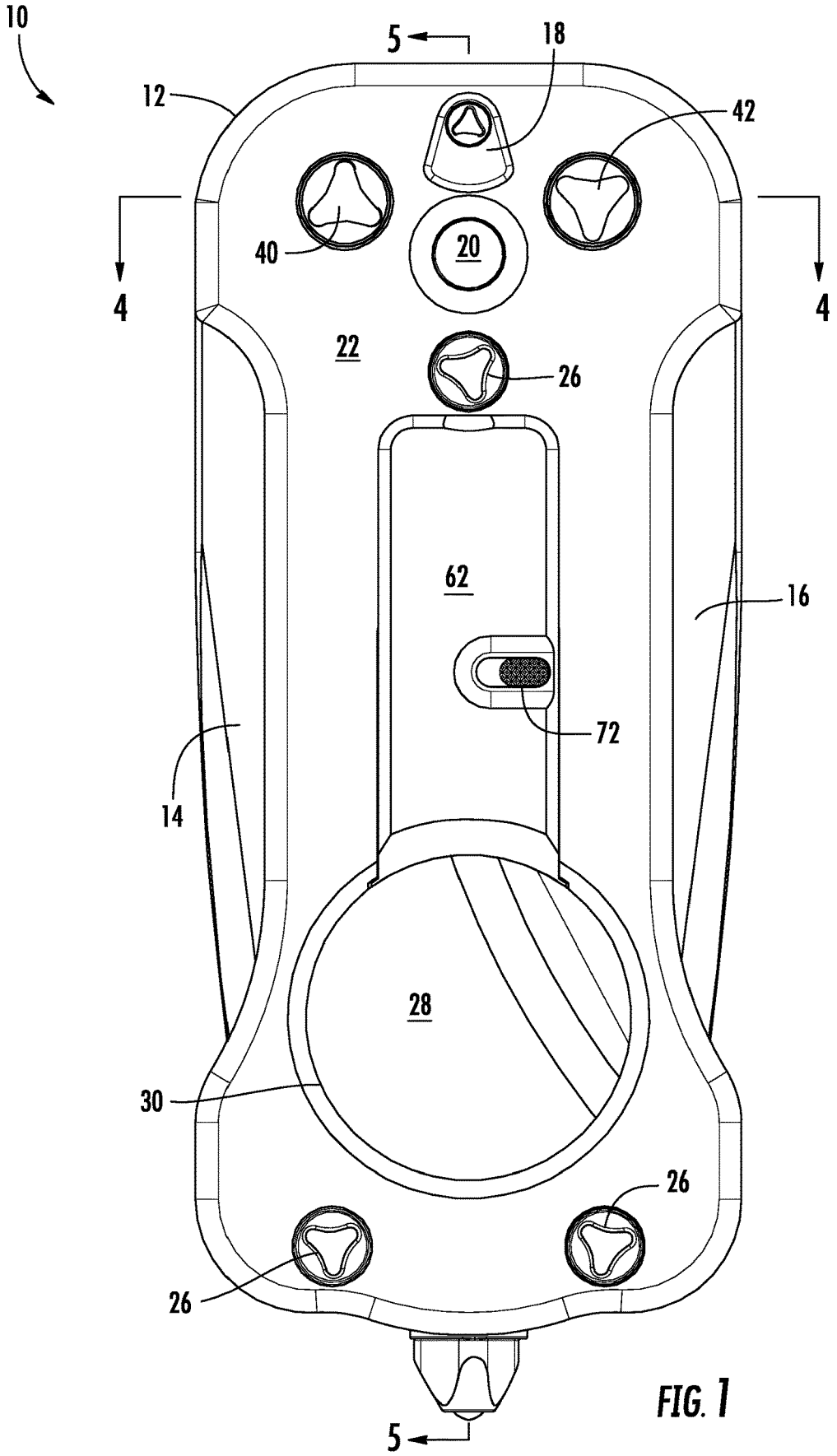
FIG. 1 is a front plan view of a cigar tool according to one embodiment of the present invention in a closed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a cigar tool that can function as a cigar cutter, a cigar punch, and/or a knife. As a cigar cutter, the tool combines the ease of manufacture and use associated with a scissors-type cigar cutter with the precision cuts associated with a guillotine-type cigar cutter. Particular embodiments of the tool may also provide a recessed cigar punch that is protected by a cover when not in use. In each embodiment, the tool includes a blade with a sharp edge which may be deployed for use as a knife if so desired.

Figure 2:
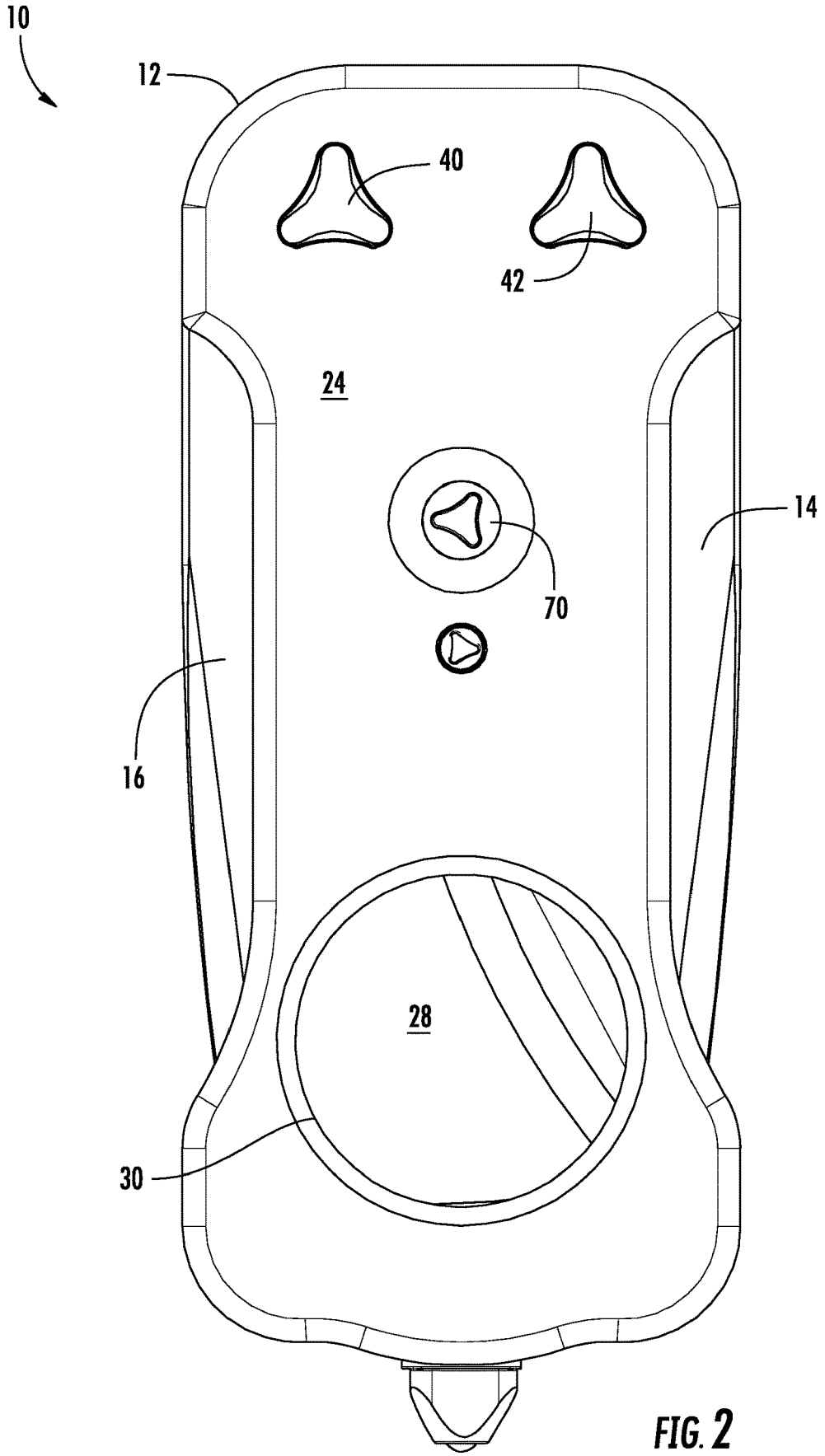
FIG. 2 is a rear plan view of the cigar tool shown in FIG. 1 in the closed position.
Figure 3:
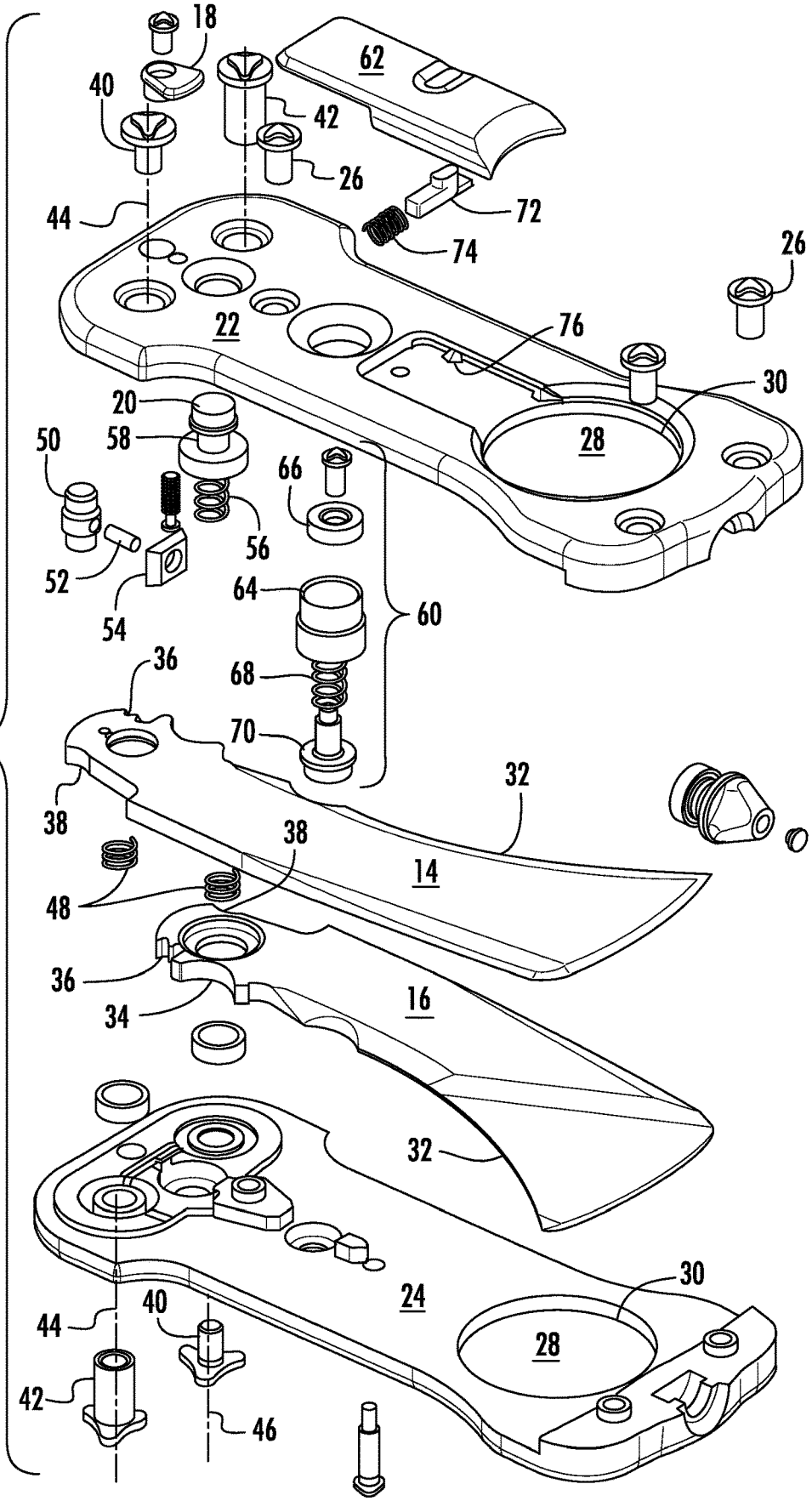
FIG. 3 is an exploded perspective view of the cigar tool shown in FIG. 1.
Figure 4:
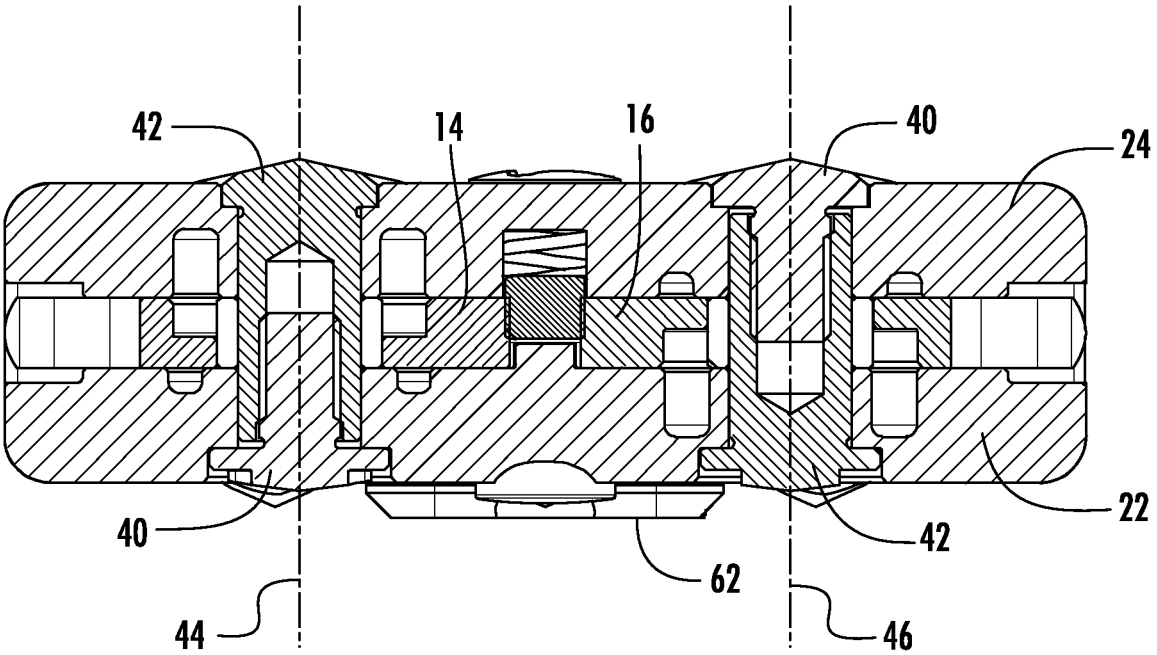
FIG. 4 is a cross-section view of the cigar tool shown in FIG. 1 taken along 4-4.

FIGS. 1 and 2 provide front and rear plan views, respectively, of a cigar tool 10 according to one embodiment of the present invention in a closed position. FIG. 3 provides an exploded perspective view of the cigar tool 10 shown in FIGS. 1 and 2, and FIG. 4 provides a cross-section view of the cigar tool 10 shown in FIG. 1 taken along 4-4. As shown in FIGS. 1-4, the cigar tool 10 generally includes a casing 12, a pair of blades 14, 16, a selector 18, and an actuator 20.

The casing 12 houses and supports the blades 14, 16 and provides the primary structure for holding the cigar tool 10 during use. The casing 12 may be constructed from metal, fiberglass, carbon, polymers, or other composite materials known in the art, and the outside of the casing 12 may include various textured surfaces to facilitate handling and gripping the cigar tool 10. The casing 12 may be a single-piece construction, but more commonly includes top and bottom scales 22, 24 connected by screws 26 on opposing sides of the blades 14, 16. As shown in FIGS. 1-3, the casing 12 forms a hole 28 that extends through both scales 22, 24 and defines a perimeter 30. The size of the hole 28 or perimeter 30 is selected to accommodate the head of a cigar when the cigar tool 10 is used as a cigar cutter.

Figure 9:
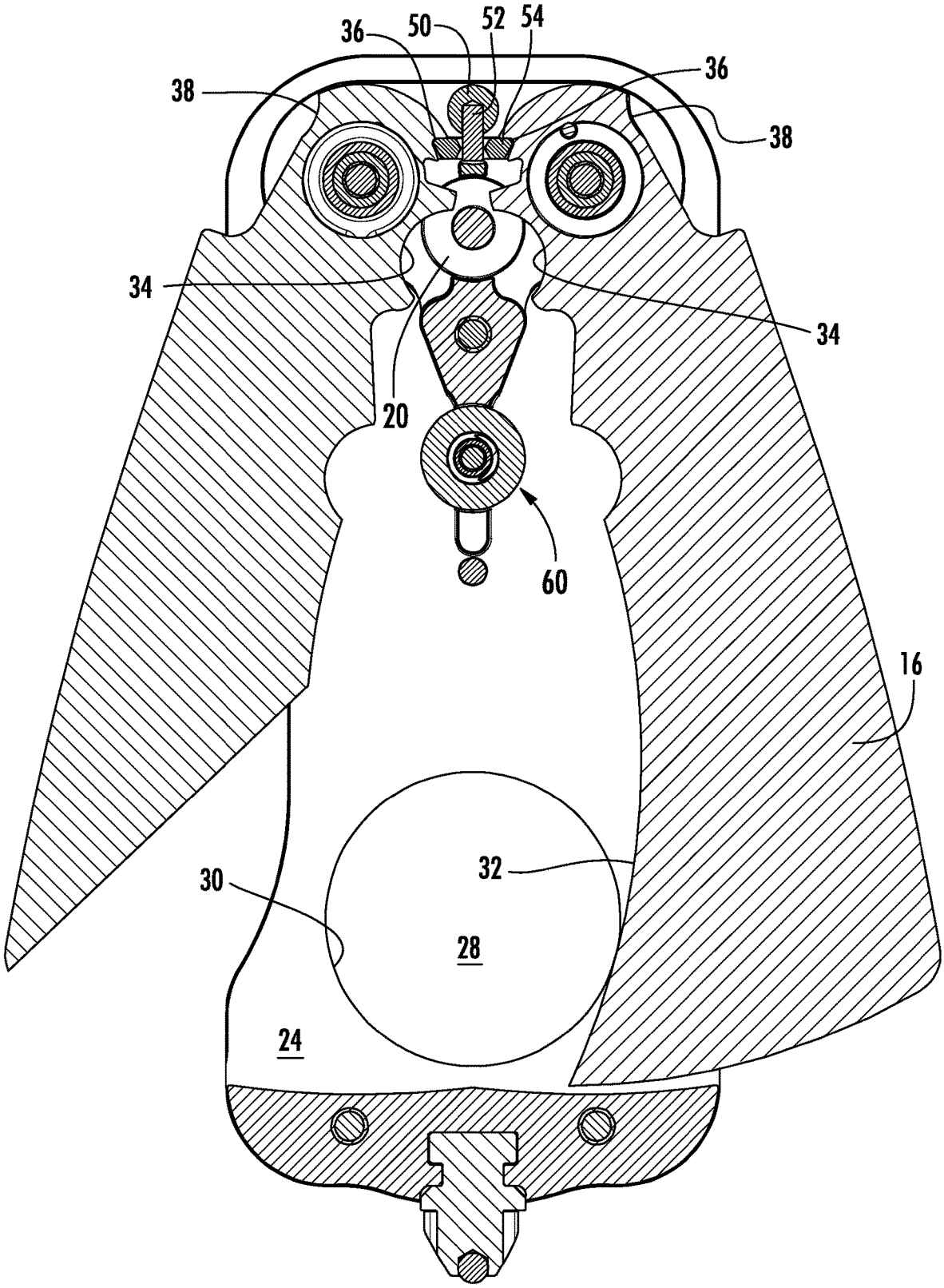
FIG. 9 is a cross-section view of the cigar tool shown in FIG. 8 taken along 9-9 in the cutter position.
Figure 10:
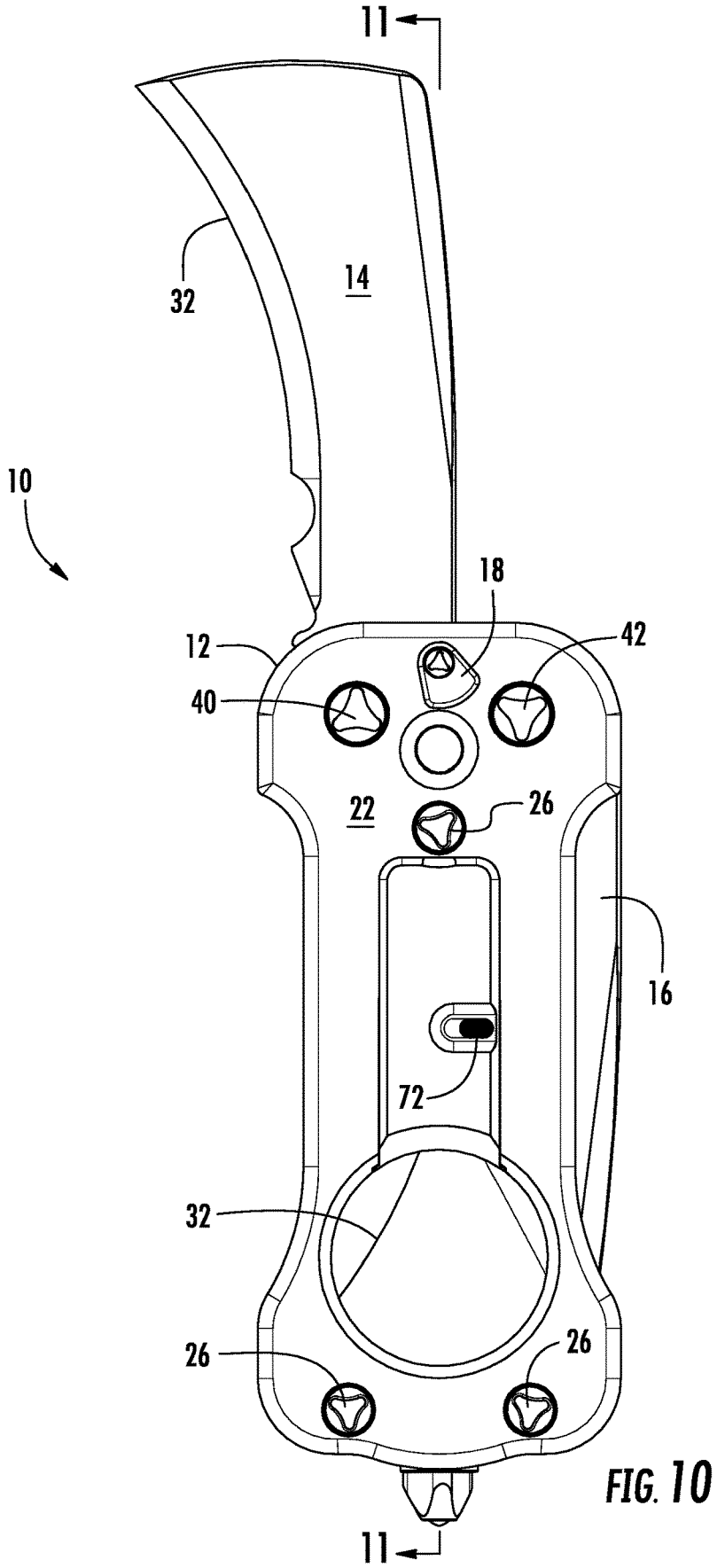
FIG. 10 is a front plan view of the cigar tool shown in FIG. 1 in a deployed position.
Figure 11:
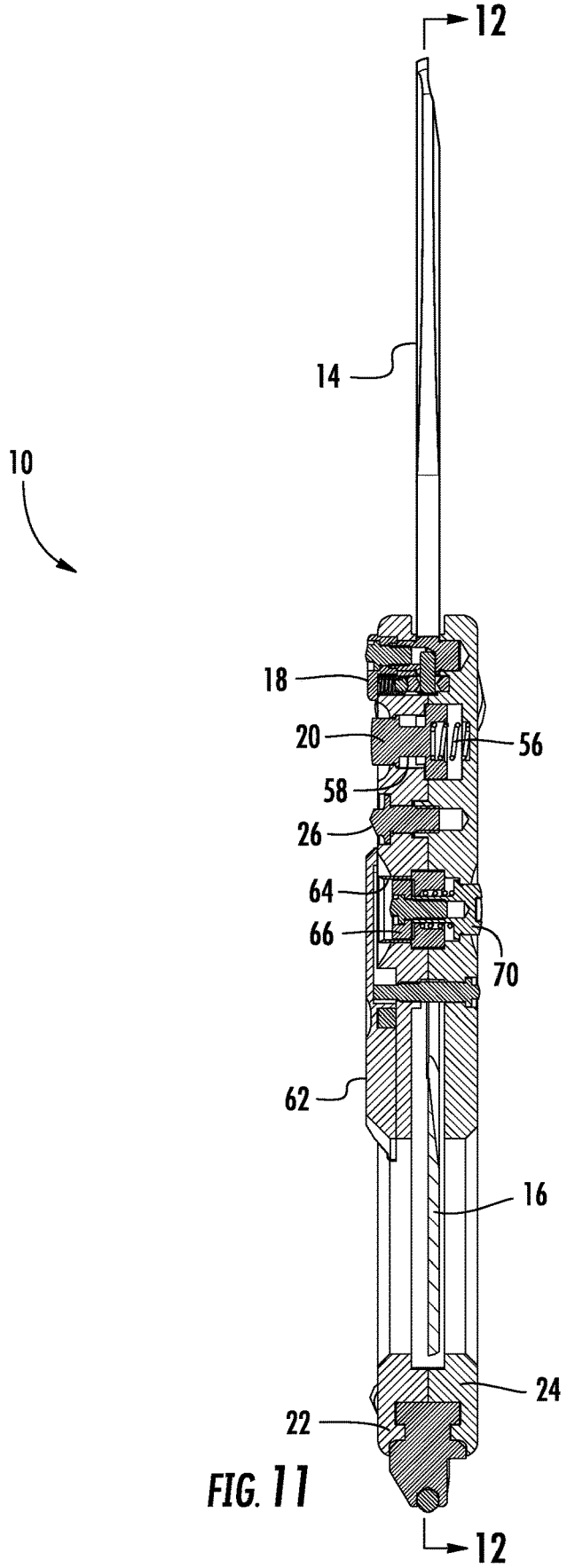
FIG. 11 is a cross-section view of the cigar tool shown in FIG. 10 taken along 11-11 in the deployed position.
Figure 12:
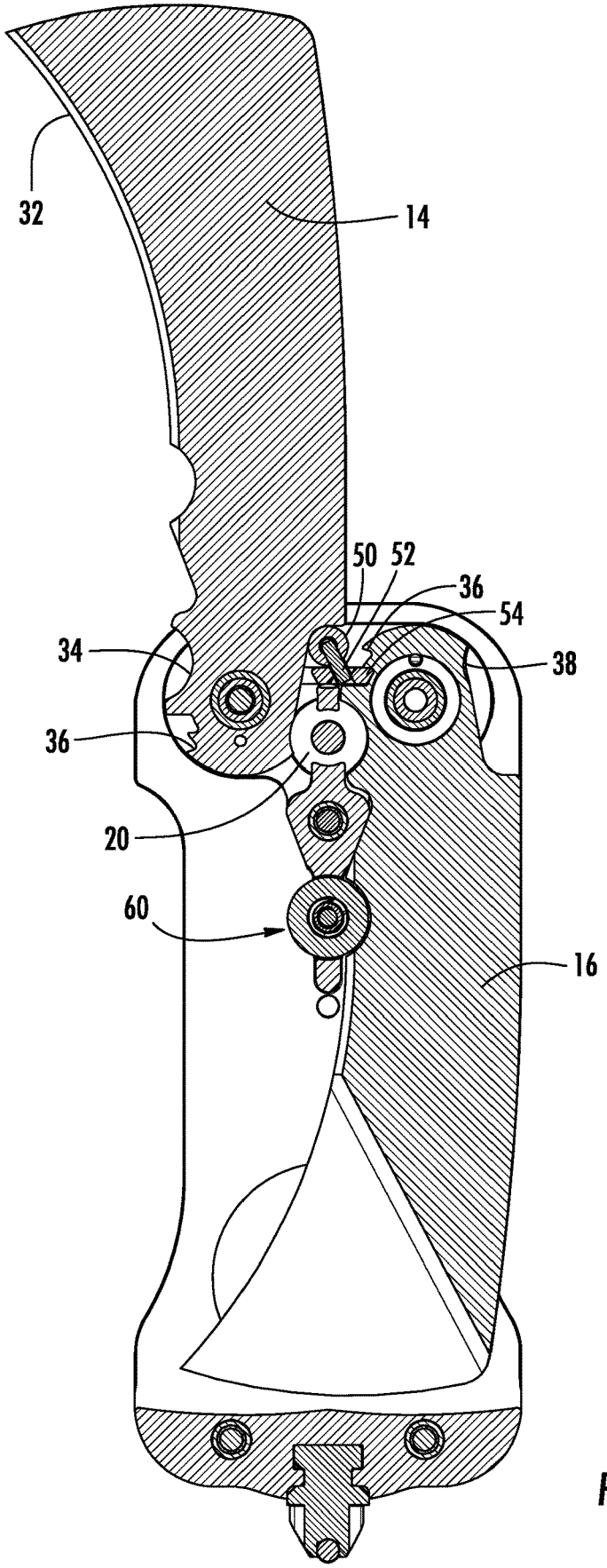
FIG. 12 is a cross-section view of the cigar tool shown in FIG. 11 taken along 12-12 in the deployed position.

The blades 14, 16 of the cigar cutter 10 may have multiple positions, such as a closed position (shown in FIGS. 1, 2, 5, and 6), a cutter position (shown in FIGS. 7-9), and a deployed position (shown in FIGS. 10-12). The blades 14, 16 may be identical to one another, with each blade 14, 16 have a cutting edge 32, a closed position detent 34, a cutter position detent 36, and/or a deployed position detent 38. The cutting edge 32 provides a sharp surface for slicing through the cap of the cigar and may be straight or curved. The closed position detent 34, cutter position detent 36, and/or deployed position detent 38 engage with the selector 18 or actuator 20 to hold the blades 14, 16 in the various positions, as will be described in more detail with respect to FIGS. 5-12.

As shown in FIGS. 1-4, the blades 14, 16 may be installed in the casing 12 so that the cutting edges 32 face and overlap one another within the hole 28 or perimeter 30 when the blades 14, 16 are in the closed position. A pair of male and female posts 40, 42 may pivotally connect each blade 14, 16 to a separate axis 44, 46 so that the blades 14, 16 rotate about different axes 44, 46. A spring 48 may be operably engaged between each blade 14, 16 and its associated female post 42 to bias the cutting edge 32 of each blade 14, 16 away from one another and out of the casing 12.

The selector 18 may be a three-position switch that selectively engages with the blades 14, 16 to allow the blades 14, 16 to move to either the cutter position, the left deployed position, or the right deployed position. As shown in FIG. 3, for example, the selector 18 may extend through a portion of the top scale 22 and include a cylindrical post 50 connected by a dowel 52 to a slide 54 inside the casing 12. In this manner, the selector 18 may be manually rotated to rotate the post 50 and selectively engage the slide 54 with the blades 14, 16 to allow one or both blades 14, 16 to move from the closed position to either the cutter position or one of the deployed positions.

The actuator 20 may be a push button that extends through at least a portion of the top scale 22 to provide convenient, manual operation of the cigar tool 10. The actuator 20 may have a hold position that prevents movement of the blades 14, 16 with respect to the casing 12 and a release position that permits movement of the blades 14, 16 with respect to the casing 12. A spring 56 under compression between the actuator 20 and the bottom scale 24 may bias the actuator 20 toward the top scale 22 to the hold position.

Figure 5:
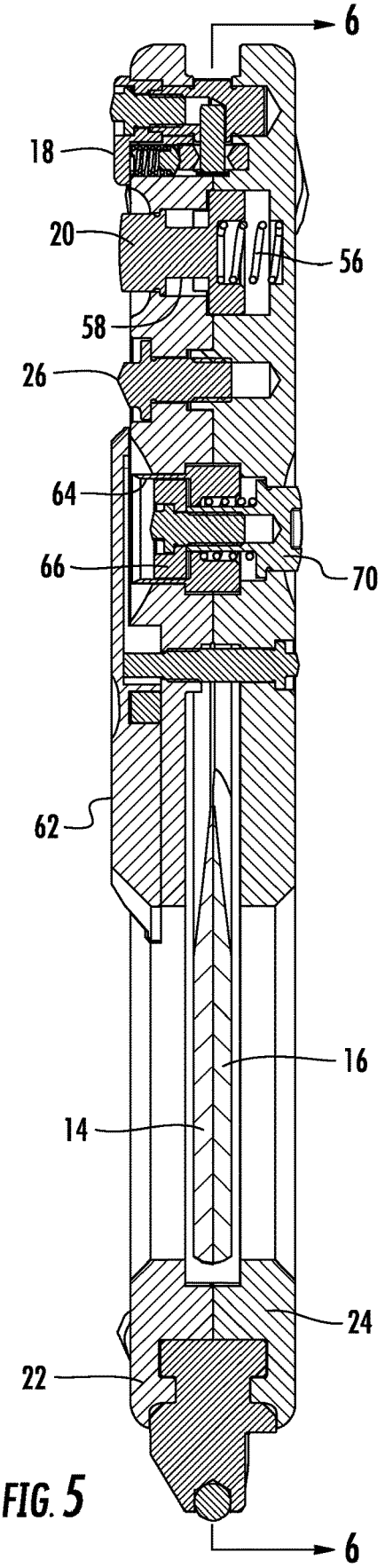
FIG. 5 is a cross-section view of the cigar tool shown in FIG. 1 taken along 5-5 in the closed position.
Figure 6:
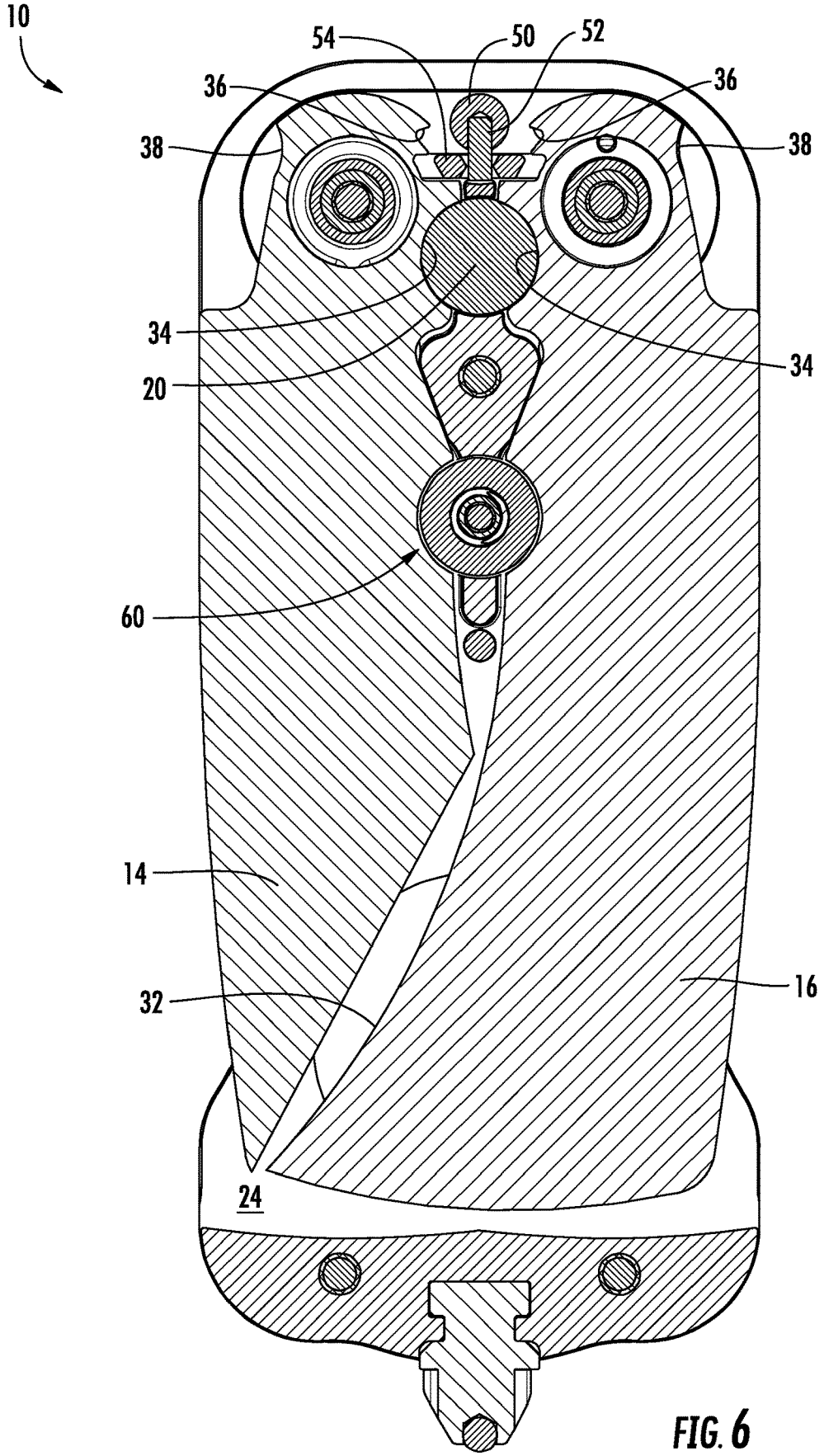
FIG. 6 is a cross-section view of the cigar tool shown in FIG. 5 taken along 6-6 in the closed position.

Operation of the cigar tool 10 will now be described. FIG. 5 provides a cross-section view of the cigar tool 10 shown in FIG. 1 taken along 5-5, and FIG. 6 provides a cross-section view of the cigar tool 10 shown in FIG. 5 taken along 6-6. As shown in FIGS. 1, 2, 5, and 6, the blades 14, 16 overlap one another within the perimeter 30 of the hole 28 when the blades 14, 16 are in the closed position so that the cigar tool 10 may be safely handled without any exposed cutting edges 32. In the closed position, the actuator spring 56 biases the actuator 20 toward the top scale 22 so the actuator 20 is in the hold position, as shown in FIG. 5. With the actuator 20 in the hold position, the closed position detent 34 for each blade 14, 16 engages with the actuator 20 to prevent the blades 14, 16 from moving with respect to the casing 12, as shown in FIG. 6. As shown in FIGS. 1 and 6, the selector 18 is in the center position so that the slide 54 is not engaged with either blade 14, 16. In the center position, the selector 18 enables the blades 14, 16 to move from the closed position to the cutter position upon operation of the actuator 20.

Figure 7:
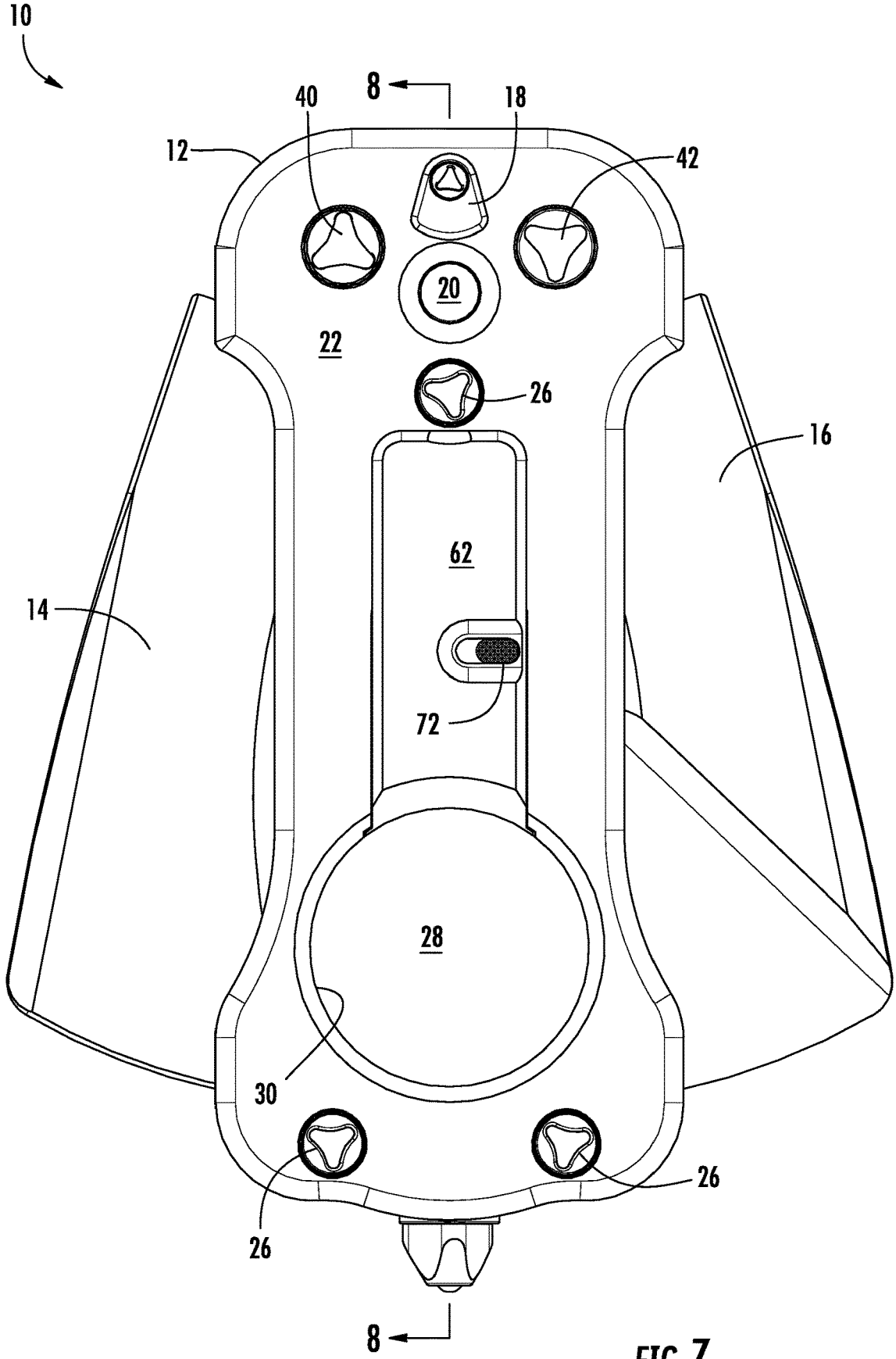
FIG. 7 is a front plan view of the cigar tool shown in FIG. 1 in a cutter position.
Figure 8:
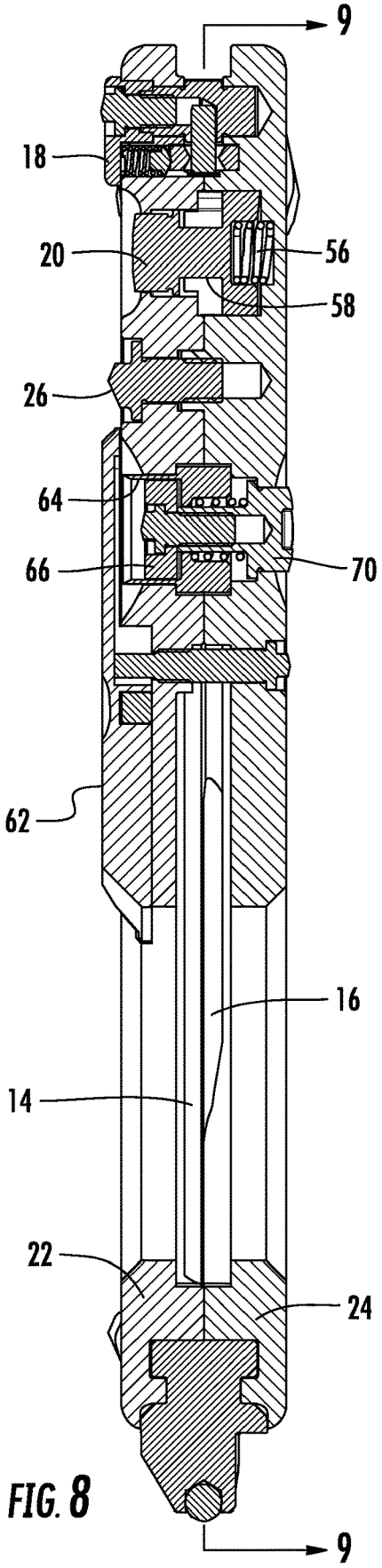
FIG. 8 is a cross-section view of the cigar tool shown in FIG. 7 taken along 8-8 in the cutter position.

FIG. 7 provides a front plan view of the cigar tool 10 shown in FIG. 1 in the cutter position. FIG. 8 provides a cross-section view of the cigar tool 10 shown in FIG. 7 taken along 8-8, and FIG. 9 provides a cross-section view of the cigar tool 10 shown in FIG. 9 taken along 9-9. As shown in FIG. 8, the actuator 20 has been depressed to overcome the bias provided by the actuator spring 56 and move the actuator 20 toward the bottom scale 24 to the release position. In the release position, a recess 58 in the actuator 20 aligns with the blades 14, 16 to permit movement of the blades 14, 16 with respect to the casing 12. With the selector 18 in the center position so that the slide 54 is not engaged with either blade 14, 16, as shown in FIGS. 1, 6, 7 and 9, the springs 48 rotate the cutting edge 32 of each blade 14, 16 away from one another. The blades 14, 16 rotate away from one another until the cutter position detent 36 of each blade 14, 16 engages with the slide 54 of the selector 18, as shown in FIG. 9.

In the cutter position, as shown in FIGS. 7-9, the blades 14, 16 are separated from one another, outside the perimeter 30, and the cutting edges 32 are within the casing 12 so that the cigar tool 10 may be safely handled without any exposed cutting edges 32. In addition, as shown most clearly in FIG. 9, a portion of the blades 14, 16 extends into the recess 58 of the actuator 20 to hold the actuator 20 in the release position. Referring to FIG. 8, a user may now hold the cigar cutter 10 in one hand while inserting the cap of a cigar through the hole 28 with the other hand. With the actuator 20 in the release position, the user may then squeeze together the opposing blades 14, 16 to overcome the bias provided by the springs 48 and rotate the cutting edge 32 of the blades toward one another to slice off the cap of the cigar. As the blades 14, 16 rotate toward one another, the portion of the blades 14, 16 no longer extends into the recess 58 of the actuator 58, allowing the actuator spring 56 to again bias the actuator 20 toward the top scale 22. The actuator 20 returns to the hold position, as shown in FIG. 5, with the closed position detent 34 of the blades 14, 16 again engaged with the actuator 20 to prevent the blades 14, 16 from moving with respect to the casing 12.

FIG. 10 provides a front plan view of the cigar tool 10 shown in FIG. 1 in the deployed position. FIG. 11 provides a cross-section view of the cigar tool 10 shown in FIG. 10 taken along 11-11, and FIG. 12 provides a cross-section view of the cigar tool 10 shown in FIG. 11 taken along 12-12. As shown in FIGS. 10 and 12, the selector 18 has been rotated counter-clockwise to the right-most position so that the slide 54 is disengaged from the left blade 14 and engaged with the right blade 16. In the right-most position, the selector 18 prevents the right blade 16 from moving and enables the left blade 14 to move from the closed position to the left deployed position upon operation of the actuator 20.

Referring to FIGS. 11 and 12, the actuator 20 has been depressed to overcome the bias provided by the actuator spring 56 and move the actuator 20 toward the bottom scale 24 to the release position. In the release position, the recess 58 in the actuator 20 aligns with the blades 14, 16 to permit movement of the blades 14, 16 with respect to the casing 12. With the selector 18 in the right-most position, the slide 54 is disengaged from the left blade 14 and engaged with the right blade 16, allowing the spring 48 for the left blade 14 to rotate the cutting edge 32 of the left blade 14 away from the right blade 16 and out of the casing 12. The left blade 14 rotates clockwise around the axis 44 until the spine of the blade 14 contacts the cylindrical post 50 of the selector 18, and the deployed position detent 38 aligns with the actuator 20. The actuator 20 is then released, causing the actuator spring 56 to move the actuator 20 toward the top scale 22 to the hold position. In the hold position, the actuator 20 again prevents movement of either blade 14, 16 with respect to the casing 12. Specifically, as shown in FIG. 12, the actuator 20 is engaged with the deployed position detent 38 of the left blade 14 and the closed position detent 34 of the right blade 16, preventing either blade 14, 16 from moving with respect to the casing 12. The user may then use the cigar tool 10 as a knife.

Referring to FIG. 3 again, the cigar tool 10 may further include a recessed cigar punch 60 within the casing 12 that is protected by a cover 62 when not in use. The cigar punch 60 may include a circular sharp blade 64, a piston 66, a spring 68, and a button 70. The sharp blade 64 provides a tool for removing a cylindrical plug from the cap of a cigar. The piston 66 may be connected to the button 70 and biased away from the sharp blade by the spring 68. In this manner, the piston 66 may be in sliding engagement with the sharp blade 64 to manually eject the removed plug from the cigar punch 60.

The cover 62 may be slidingly engaged with the top scale 22 and have a closed position (shown in FIGS. 1, 7, and 10) that shields the cigar punch 60 from access and an open position (shown in FIG. 13) that provides access to the cigar punch 60. As shown in FIG. 3, the cover 62 may include a latch 72 biased by a spring 74 to a latched position that prevents the cover 62 from sliding with respect to the casing 12. As shown in FIGS. 1 and 3, for example, the cover 62 is in the closed position, and the spring 74 has biased the latch 72 to the right to engage with a detent 76 in the top scale 22 to prevent the cover 62 from sliding with respect to the casing 12.

Figure 13:
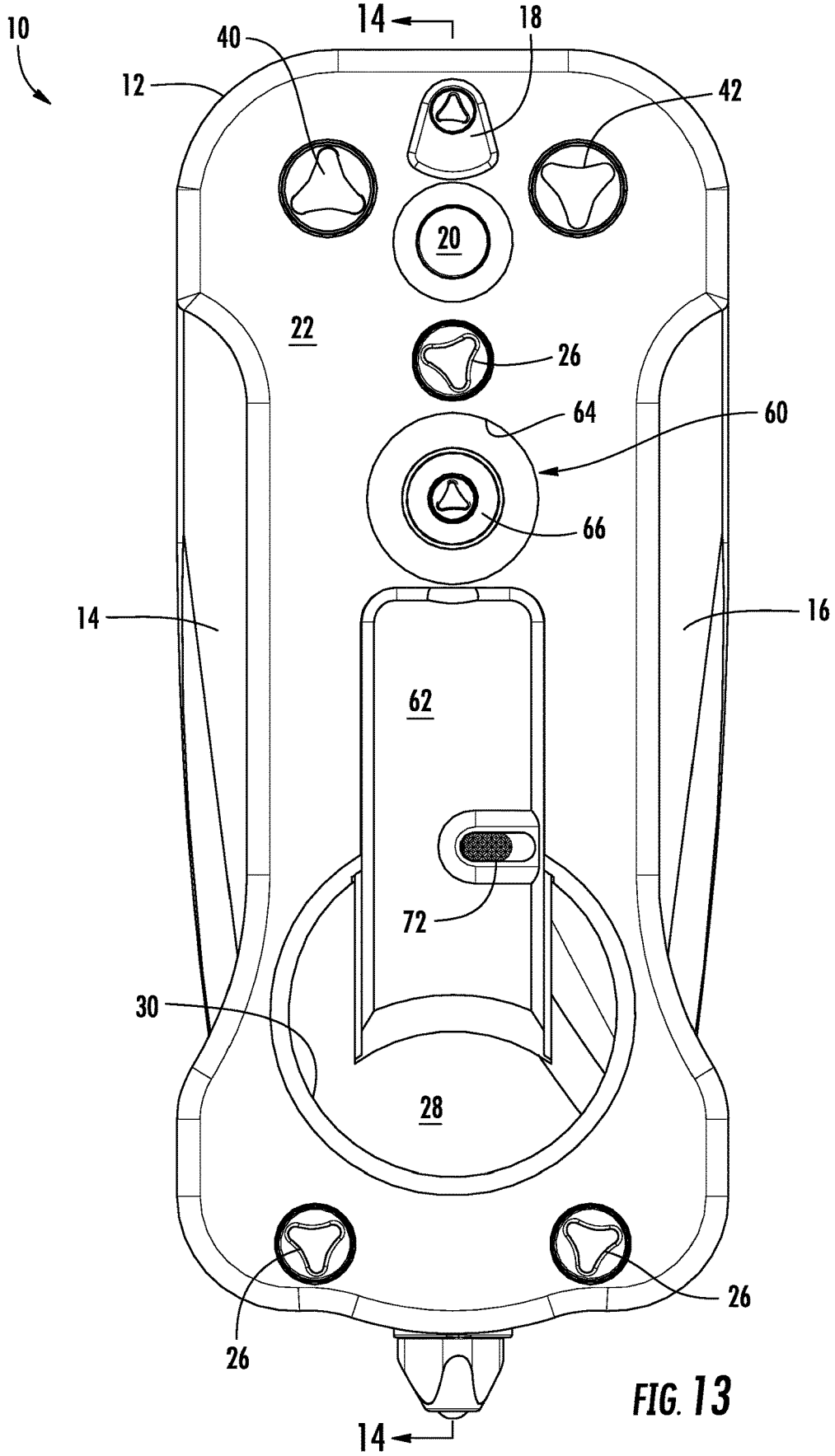
FIG. 13 is a front plan view of the cigar tool shown in FIG. 1 with the cover in an open position.
Figure 14:
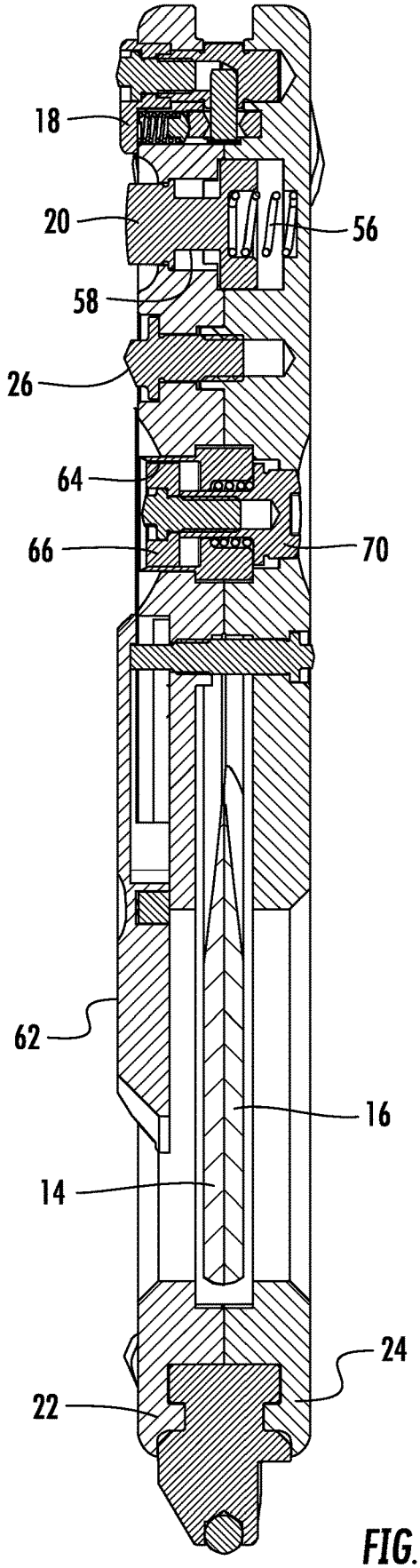
FIG. 14 is a cross-section view of the cigar tool shown in FIG. 13 taken along 14-14.

FIG. 13 provides a front plan view of the cigar tool 10 shown in FIG. 1 with the cover 62 in the open position, and FIG. 14 provides is a cross-section view of the cigar tool 10 shown in FIG. 13 taken along 14-14. As shown in FIG. 13, the latch 72 has been moved to the left against the spring 74 bias to disengage the latch 72 from the detent 76 in the top scale 22, and the cover 62 has been slid downward to the open position to provide access to the cigar punch 60. The user may then hold the cigar cutter 10 in one hand while pressing the cap of the cigar against the sharp blade 64 of the cigar punch 60 with the other hand and rotating the cigar and/or the cigar tool 10 to cut through the head of the cigar and remove a plug from the cigar. If the removed plug remains within the circle formed by the sharp blade 64, the user may depress the button 70 extending through the bottom scale 24 to overcome the spring 68 bias and reciprocate the piston 66 in the cigar punch 60 to eject the removed plug, as shown in FIG. 14.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A cigar tool, comprising:

a casing;

a hole through the casing, wherein the hole defines a perimeter;

a pair of blades pivotally connected to the casing, wherein each blade has a cutting edge, and the pair of blades has a closed position in which the pair of blades overlap one another within the perimeter, a cutter position in which the pair of blades are separated from one another, outside the perimeter, and the cutting edges are within the casing, and a deployed position in which the cutting edge of one blade is outside the casing;

a spring operably engaged with each blade to bias the cutting edge of each blade out of the casing;

an actuator that extends through at least a portion of the casing, wherein the actuator has a hold position that prevents movement of the pair of blades with respect to the casing and a release position that permits movement of the pair of blades with respect to the casing; and a selector selectively engaged with the pair of blades to allow the pair of blades to move to either the cutter position or the deployed position.

2. The cigar tool as in claim 1, wherein each blade of the pair of blades rotates about a different axis.

3. The cigar tool as in claim 1, wherein the actuator is biased to the hold position.

4. The cigar tool as in claim 1, wherein the pair of blades holds the actuator in the release position when the pair of blades is in the cutter position.

5. The cigar tool as in claim 1, further comprising a cover slidingly engaged with the casing, wherein the cover has a closed position and an open position.

6. The cigar tool as in claim 5, further comprising a cigar punch within the casing, wherein the cigar punch is accessible through the casing when the cover is in the open position.

7. The cigar tool as in claim 6, further comprising a piston in sliding engagement with the cigar punch.

8. A cigar tool, comprising:

a casing;

a hole through the casing;

a pair of blades pivotally connected to the casing, wherein each blade has a cutting edge, a closed position detent, a cutter position detent, and a deployed position detent;

a spring operably engaged with each blade to bias the cutting edge of each blade out of the casing;

an actuator that extends through at least a portion of the casing, wherein the actuator has a hold position that prevents movement of the pair of blades with respect to the casing and a release position that permits movement of the pair of blades with respect to the casing; and a selector selectively engaged with the pair of blades to allow the pair of blades to move between a closed position in which each closed position detent is engaged with the actuator, a cutter position in which each cutter position detent is engaged with the selector, and a deployed position in which one deployed position detent is engaged with the actuator.

9. The cigar tool as in claim 8, wherein each blade of the pair of blades rotates about a different axis.

10. The cigar tool as in claim 8, wherein the pair of blades holds the actuator in the release position when the pair of blades is in the cutter position.

11. The cigar tool as in claim 8, further comprising a cover slidingly engaged with the casing, wherein the cover has a closed position and an open position.

12. The cigar tool as in claim 11, further comprising a cigar punch within the casing, wherein the cigar punch is accessible through the casing when the cover is in the open position.

13. The cigar tool as in claim 12, further comprising a piston in sliding engagement with the cigar punch.

14. A cigar tool, comprising:

a casing;

a pair of blades pivotally connected to the casing, wherein each blade has a cutting edge, and the pair of blades has a deployed position in which the cutting edge of one blade is outside the casing;

a spring operably engaged with each blade to bias the cutting edge of each blade out of the casing;

an actuator that extends through at least a portion of the casing, wherein the actuator has a hold position that prevents movement of the pair of blades with respect to the casing and a release position that permits movement of the pair of blades with respect to the casing;

a cover slidingly engaged with the casing, wherein the cover has a closed position and an open position; and a cigar punch within the casing, wherein the cigar punch is accessible through the casing when the cover is in the open position.

15. The cigar tool as in claim 14, wherein each blade of the pair of blades rotates about a different axis.

16. The cigar tool as in claim 14, wherein at least one blade of the pair of blades has a deployed position detent engaged with the actuator when the pair of blades is in the deployed position.

17. The cigar tool as in claim 14, further comprising a hole through the casing, wherein the hole defines a perimeter, and the pair of blades has a closed position in which the pair of blades overlap one another within the perimeter and a cutter position in which the pair of blades are separated from one another, outside the perimeter, and the cutting edges are within the casing.

18. The cigar tool as in claim 17, wherein each blade has a closed position detent engaged with the actuator when the pair of blades is in the closed position.

19. The cigar tool as in claim 17, wherein the pair of blades holds the actuator in the release position when the pair of blades is in the cutter position.

20. The cigar tool as in claim 14, further comprising a piston in sliding engagement with the cigar punch.

* * * * *